US007314154B2

(12) United States Patent
Huang et al.

(10) Patent No.: US 7,314,154 B2
(45) Date of Patent: Jan. 1, 2008

(54) SHIFT LEVER SWITCHING MECHANISM FOR A TRIGGER

(75) Inventors: Leo Huang, Taichung (TW); Sam Yu, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/685,033

(22) Filed: Mar. 12, 2007

(65) Prior Publication Data

US 2007/0246503 A1 Oct. 25, 2007

(30) Foreign Application Priority Data

Apr. 24, 2006 (TW) ..... 95114562 A

(51) Int. Cl.
*B25C 1/04* (2006.01)

(52) U.S. Cl. ..... 227/8; 227/130

(58) Field of Classification Search ..... 227/8, 227/130, 142, 156

See application file for complete search history.

(56) References Cited

U.S. PATENT DOCUMENTS 5,593,079 A * 1/1997 Mukoyama et al. ..... 227/8
5,785,227 A * 7/1998 Akiba ..... 227/8
6,059,161 A * 5/2000 Chang et al. ..... 227/8
6,213,372 B1 * 4/2001 Chen ..... 227/8
6,659,324 B1 * 12/2003 Liu ..... 227/8
6,860,416 B1 * 3/2005 Chen ..... 227/8
6,929,165 B1 * 8/2005 Chen et al. ..... 227/8
6,953,137 B2 * 10/2005 Nakano et al. ..... 227/8
7,004,367 B1 * 2/2006 Shen et al. ..... 227/8
7,143,918 B2 * 12/2006 Aguirre et al. ..... 227/8
7,152,773 B2 * 12/2006 Ke ..... 227/8
7,213,732 B2 * 5/2007 Schell et al. ..... 227/8

* cited by examiner

*Primary Examiner*—Scott A. Smith
(74) *Attorney, Agent, or Firm*—Egbert Law Offices

(57) ABSTRACT

The shift lever switching mechanism for a trigger is mounted onto the trigger body of a nailer. The mechanism has a guide groove passing laterally through the trigger, two positioning sections placed at intervals, and a shift lever. A control button is placed at one end of the shift lever with a container. Thus, the first positioning section aligns when the shift lever moves to the first position, and the second positioning section aligns when the shift lever moves to the second position. A flexible locator, mounted onto the shift lever and provided with a flexible snapper, is snapped with the first positioning section when the shift lever moves to the first position, or is snapped with the second positioning section when the shift lever moves to the second position. A motion tab has one end linked to the shift lever and another end extended opposite to form a driving section.

6 Claims, 9 Drawing Sheets

SHIFT LEVER SWITCHING MECHANISM FOR A TRIGGER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a nailer structure, and more particularly to an innovative shift lever switching mechanism for a trigger of a nailer.

2. Description of Related Art Including Information Disclosed Under 37 CFR 1.97 and 37 CFR 1.98.

Today, many nailers are available with a switching function for single triggering and continuous triggering in order to meet the requirements of users. The present invention aims to make a breakthrough innovation for the switching mechanism of the trigger.

Referring to FIG. 1, a typical switching mechanism comprises an eccentric regulating rod 10 and a trigger disc 20. The eccentric regulating rod 10 comprises a pressure plate 11, an eccentric rod 12 and a knob 13. The eccentric regulating rod 10 is mounted into a through groove 06 of the trigger 05. The knob 13 is normally recessed since the pressure plate 11 is supported by a return spring 14. The operator pulls out the knob 13 and then rotates the knob 13 (shown in FIG. 2), such that the eccentric rod 12 rotates eccentrically, driving the trigger disc 20 to generate displacement in relation to the safety lever. Next, the knob 13 is relaxed for flexible reset, thereby completing the switching action. In the actual operation, the nailer must be put down or reversed first, and then the knob 13 is manually held and pulled out to allow for rotation and subsequent relaxation. The sequence is inconvenient. Also, the manual control area of knob 13 is limited to the space of the trigger, making it impossible to provide more desirable operation and control of the knob 13.

Referring to FIG. 3, another typical switching mechanism comprises a rotating shaft 30, two springs 31 and two press buttons 32. The rotating shaft 30 is mounted within the trigger 33, and two press buttons 32 are oppositely screwed into a slide shaft 301 at both sides of rotating shaft 30. Two press buttons 32 shift flexibly outwards due to the support of spring 31, so snapper flanges 321 outside of two press buttons 32 snap into spacing groove 331 opposite the trigger 33. If the rotating shaft 30 and trigger disc 34 are to be shifted, as shown in FIG. 4, the operator must press internally two press buttons 32 with two fingers, such that the snapper flange 321 is disengaged from the spacing groove 331. So, it becomes possible to push smoothly the press button 32 and drive the rotating shaft 30. In actual operation, inconsistent manual pressure may lead to asynchronous disengagement and subsequent jamming, and the complex construction of this switching mechanism may bring about more manufacturing cost and time consuming assembly.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The present invention includes a shift lever switching mechanism for a trigger with a control button 61 placed at one end of the shift lever 60. A flexible locator 70 is separately snapped into the first and second positioning sections 51, 52 when the shift lever 60 moves to the first and second positions, respectively. The present invention enables smooth switching of the shift lever and motion tab by using only a finger. So, unlike the eccentric switching mechanism (shown in FIGS. 1, 2) and push type switching mechanism (shown in FIGS. 3, 4) disclosed in description of the prior art, the present invention permits the operator more convenient and smooth to control of switching between single triggering and continuous triggering.

In the present invention, the shift lever 60 and control button 61 are integrally pre-formed. The flexible locator 70 can be assembled simply by beads and springs. In contrast to the prior art eccentric switching mechanism and push type switching mechanism, the present invention offers simple construction and good cost effectiveness, thus creating a greater capability for mass production.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 2:
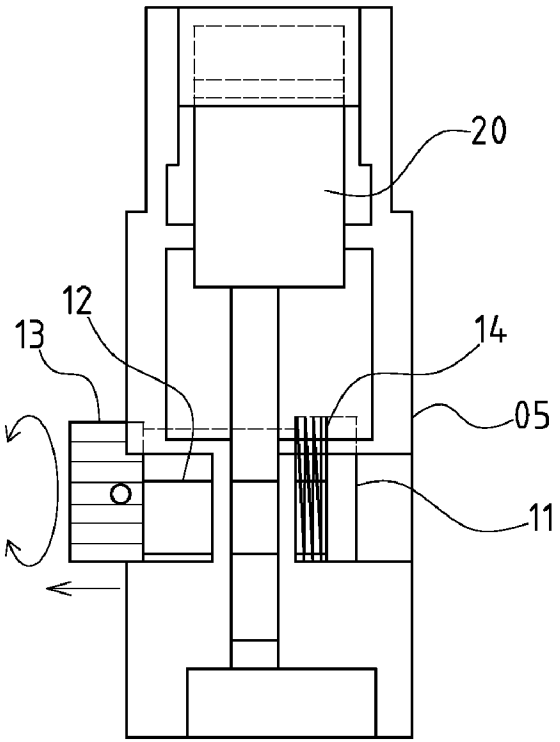
FIG.2 PRIOR ART
FIG. 2 shows a cross-sectional view of the prior art of FIG. 1.
Figure 1:
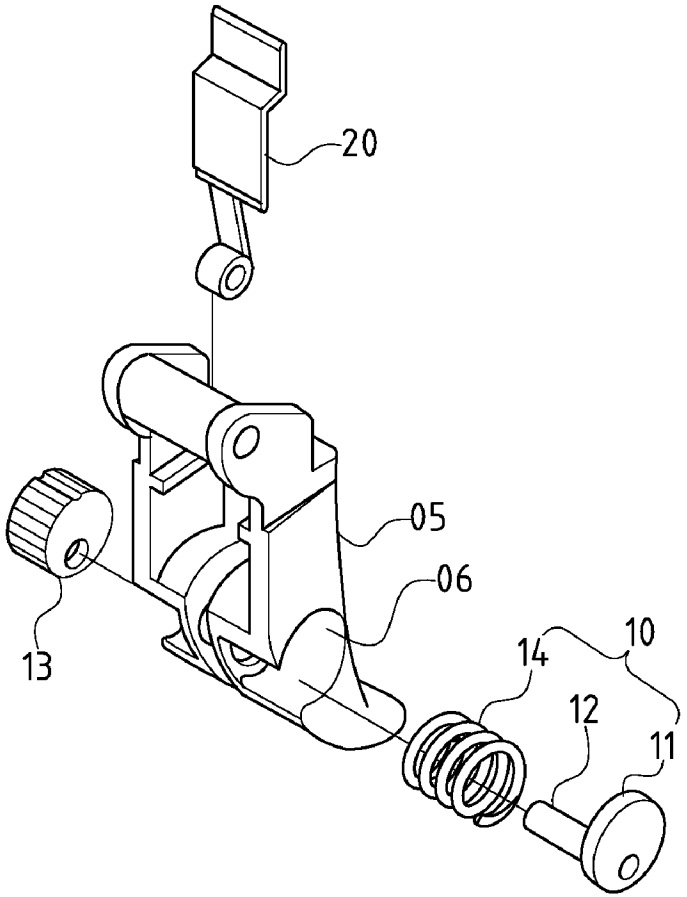
FIG.1 PRIOR ART
FIG. 1 shows an exploded perspective view of a prior art eccentric switching mechanism.
Figure 4:
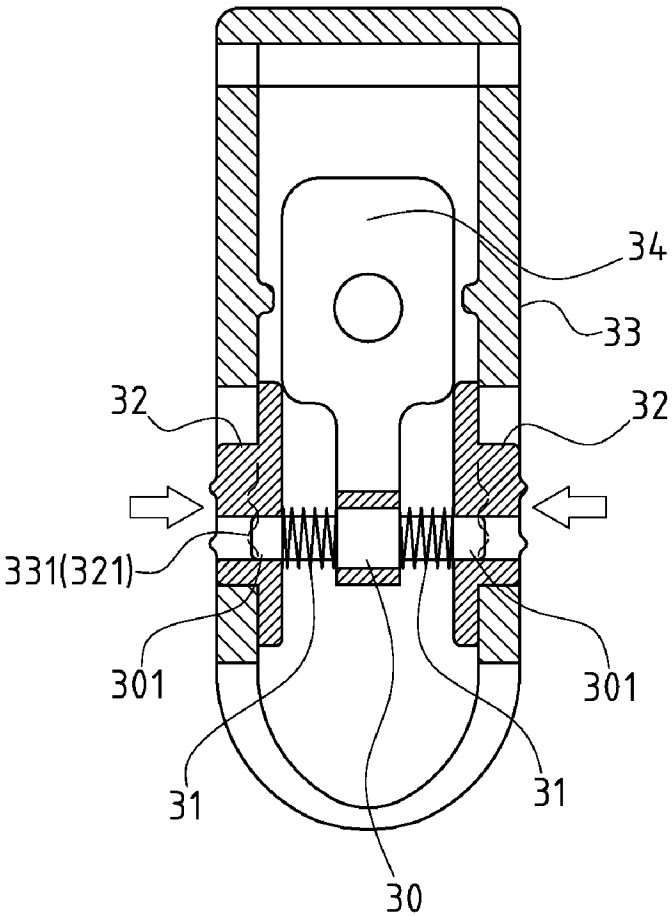
FIG.4 PRIOR ART
FIG. 4 shows a cross-sectional view of the prior art of FIG. 2.
Figure 3:
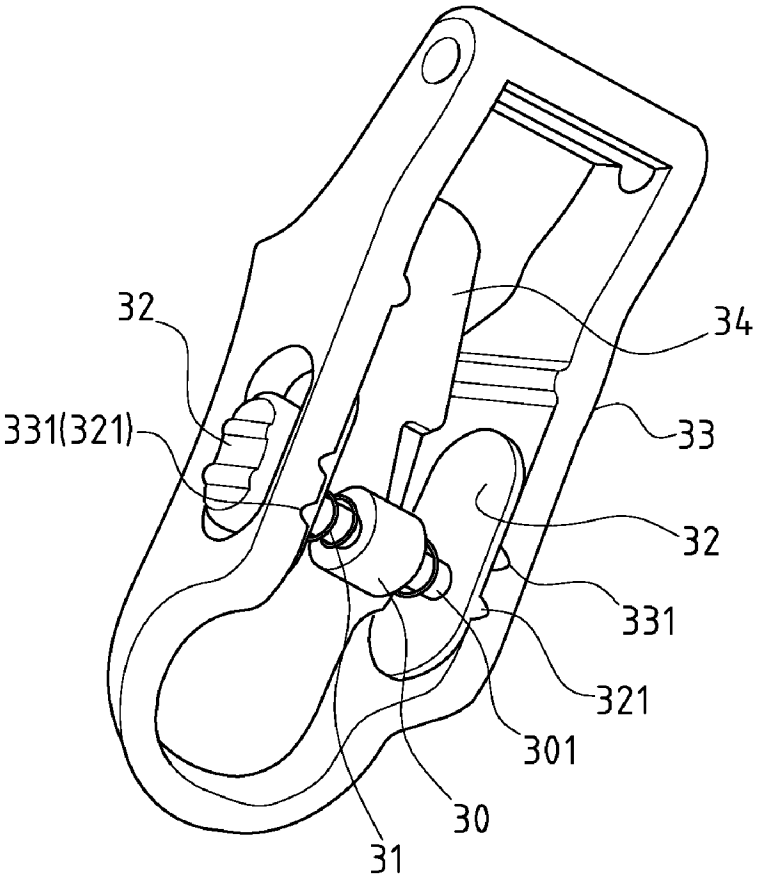
FIG.3 PRIOR ART
FIG. 3 shows a perspective view of a prior art push-type switching mechanism.
Figure 5:
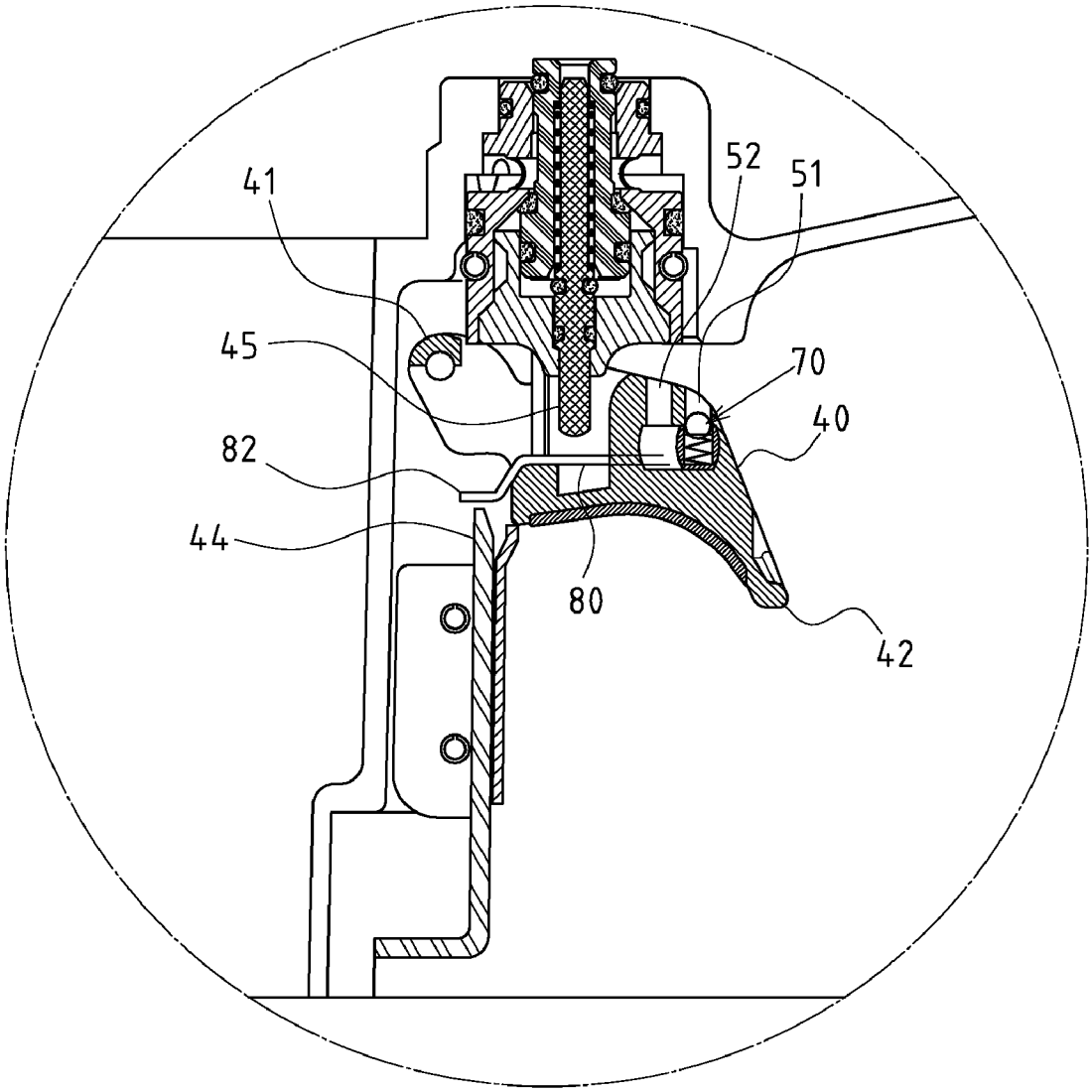
FIG. 5 shows a cross-sectional view of a preferred embodiment of the shift lever switching mechanism of the present invention.
Figure 6:
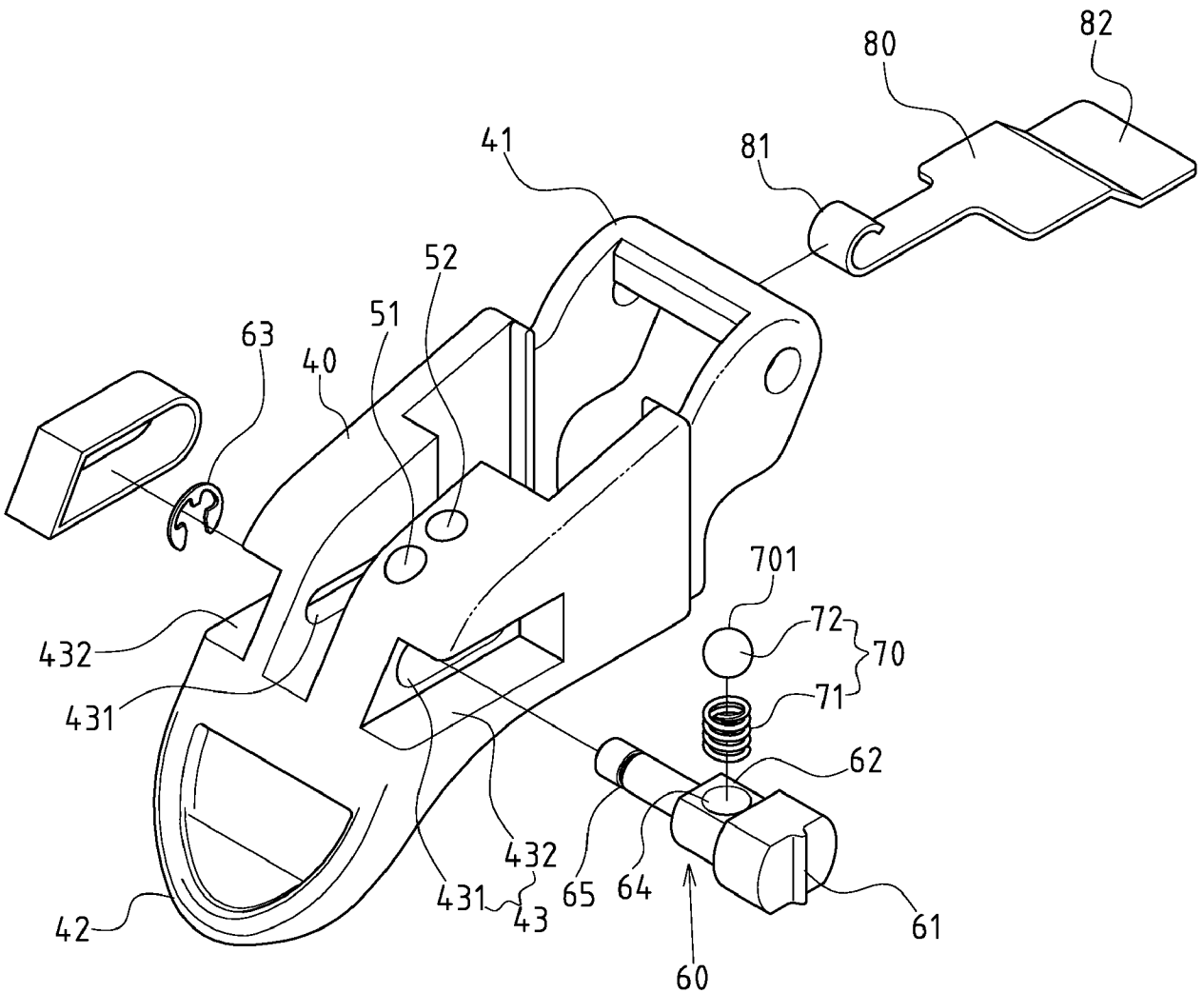
FIG. 6 shows an exploded perspective view of the preferred embodiment of the present invention of FIG. 5.
Figure 7:
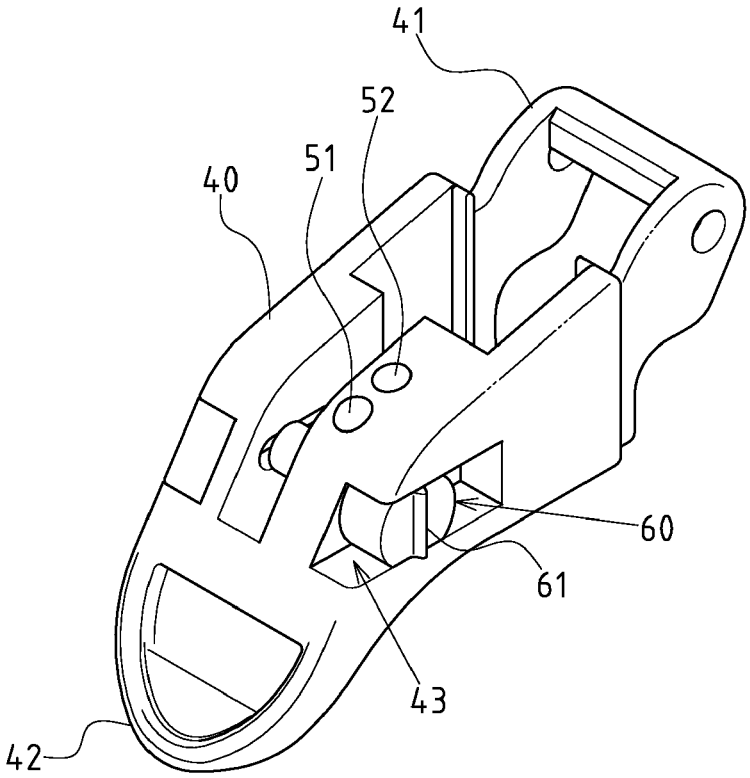
FIG. 7 shows an assembled perspective view of the preferred embodiment of the present invention of FIG. 5.
Figure 8:
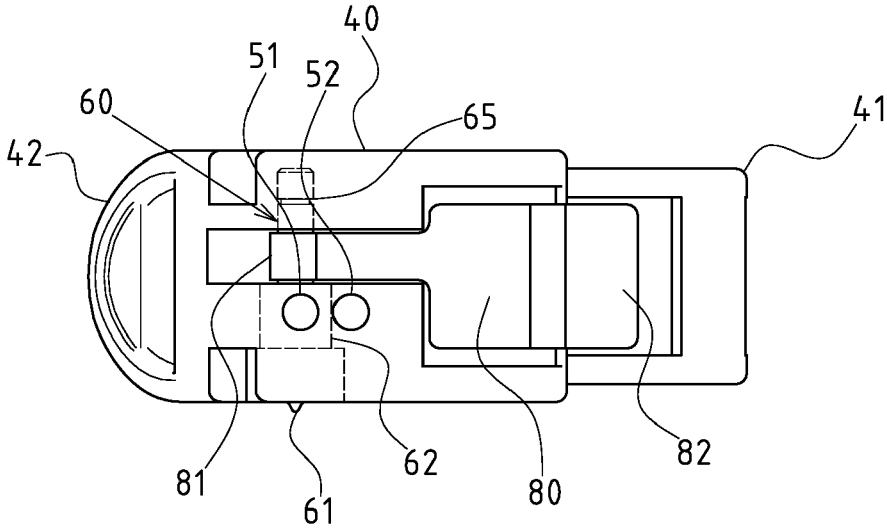
FIG. 8 shows an elevation view of a preferred embodiment of the present invention of FIG. 5.

FIGS. 5, 6 and 7 depict preferred embodiments of the shift lever switching mechanism for a trigger of the present invention. Referring to FIG. 5, the switching mechanism is mounted onto the trigger 40 of a nailer. The trigger 40 comprises a pin joint end 41 and a trigger end 42, which triggers an air switch 45 under the preset drive of safety lever 44 of the nailer.

The switching mechanism includes a guide groove 43, which is mounted between pin joint end 41 and trigger end 42 of the trigger 40, and passes laterally through the trigger 40. The guide groove 43 of the present invention also comprises an internal long through hole 431 and an external grooved section 432.

Figure 10:
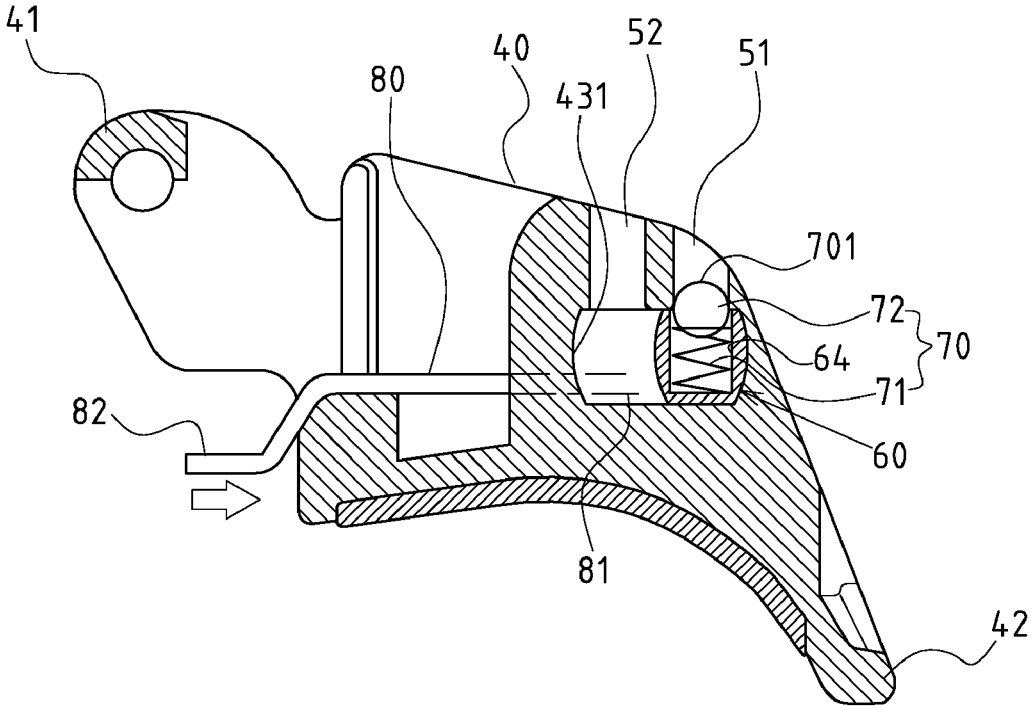
FIG. 10 shows another cross-sectional view of the preferred embodiment of FIG. 5 in operation.

The present invention also includes a first positioning section 51 and a second positioning section 52, available in a through hole pattern and arranged at intervals onto a preset location of the guide groove 43. Referring to FIGS. 6 and 10, the first and second positioning sections 51, 52 of the present invention are arranged at two parallel through holes opposite the pin joint end 41 and trigger end 42 of the trigger 40. The bottoms of the through holes are linked vertically to the grooved section 432 outside of guide groove 43.

A shift lever 60 is mounted within the guide groove 43, shifting a preset distance along the direction opposite to the pin joint end 41 and trigger end 42 of the trigger 40. One end of the shift lever 60 is provided with a control button 61. A positioning section 62 of shift lever 60 aligns with the first positioning section 51 when the shift lever 60 shifts to the first position. The positioning section 62 aligns with the second positioning section 52 when the shift lever 60 shifts to the second position. The other end of the control button 61 is provided with a blocker 65, where a snap ring 63 firmly limits the shift lever 60.

A flexible locator 70 is mounted onto a preset location of shift lever 60. The flexible locator 70 has a flexible snapper 701, which allows snapping with the first positioning section 51 when the shift lever 60 shifts to the first position, or snapping with the second positioning section 52 when the shift lever 60 shifts to the second position. The flexible locator 70 of the present invention comprises a flexible member 71 and a bead 72. A container 64 is placed at the positioning section of shift lever 60 for insertion of flexible member 71 and bead 72, thereby forming the flexible snapper 701 at the top of bead 72 protruding from the positioning section 62.

A long motion tab 80 has one end 81 linked to the middle section of the shift lever 60, and another end extended towards the opposite direction to form a driving section 82. Referring to FIG. 5, the driving section is driven by the safety lever 44 of the nailer.

Based upon above specified structures, the present invention operates as detailed herein.

The shift lever 60 of the present invention, unlike the typical prior art structures shown in FIGS. 1-4, is fitted with a control button 61 for easier control. The control button 61 can be easily controlled by a finger without needing to be placed down or rotation.

Figure 9:
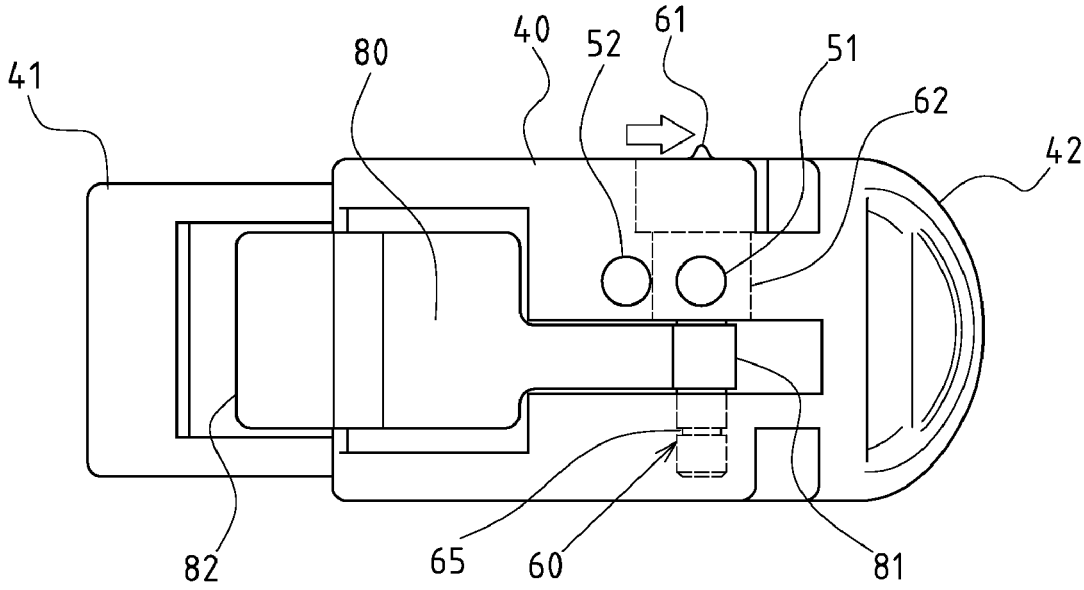
FIG. 9 shows another elevation view of the preferred embodiment of FIG. 5 in operation.

Referring to FIGS. 5, 9 and 10, when the shift lever 60 shifts to the first location, the flexible snapper 701 of flexible locator 70 is snapped securely with the first positioning section 51 of trigger 40. In such a case, the motion tab 80 moves towards the trigger end 42, making it possible to set a single triggering mode for nailer with the same operating principle. When the safety lever 44 presses the targets for nailing purposes, it will push the driving section 82 of motion tab 80 to swing inwards for contact with air switch 45. In such case, a triggering action is activated if the trigger 40 is pressed. Once upon triggering, the recoil of the nailer will force the safety lever 44 to separate from the target, placing the driving section 82 of motion tab 80 in a released state. So, the driving section will depart from the movement path of safety lever 44, thus a single triggering mode is made available even if the operator continuously holds the trigger and forces the safety lever 44 to press against the targets.

Figure 11:
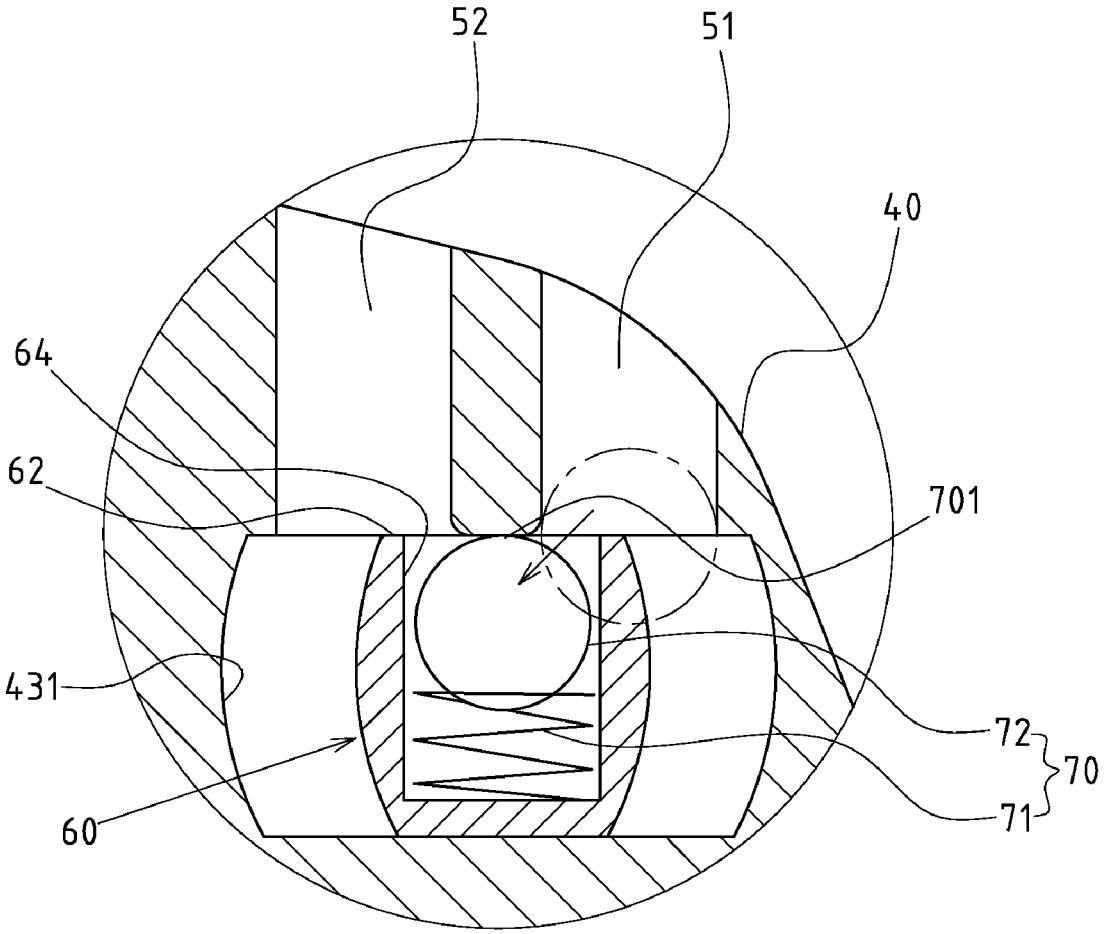
FIG. 11 shows an enlarged isolated schematic view of the flexible locator of the present invention in operation.

Referring to FIG. 11, when the operator enables the shift lever 60 to move from the first positioning section 51 to the second positioning section 52, the bead 72 of flexible locator 70 will be forcibly lowered down to squeeze the flexible member 71.

Figure 12:
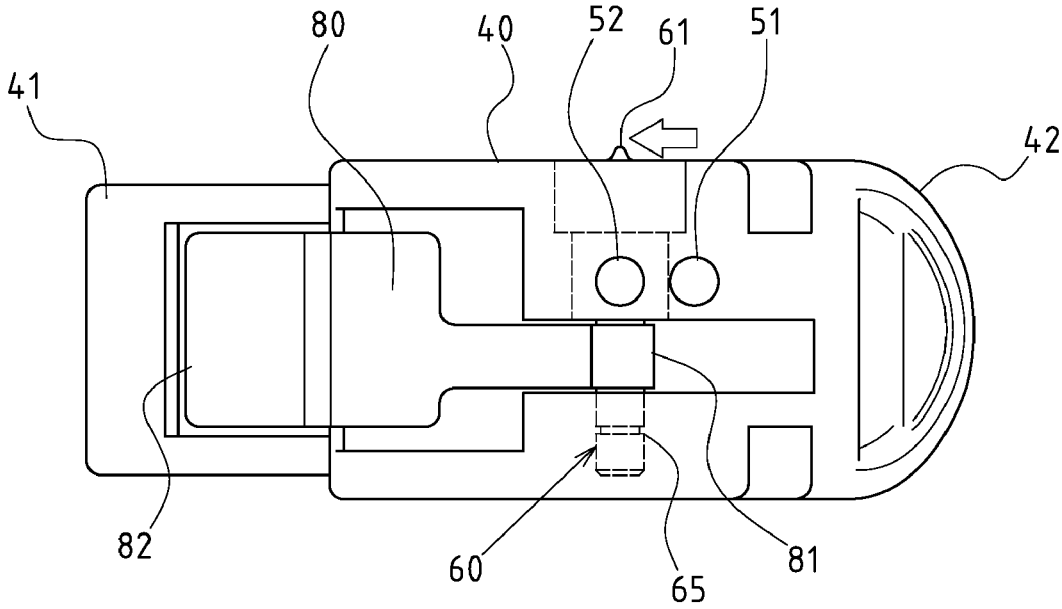
FIG. 12 shows another elevation view of the preferred embodiment in another operation.
Figure 13:
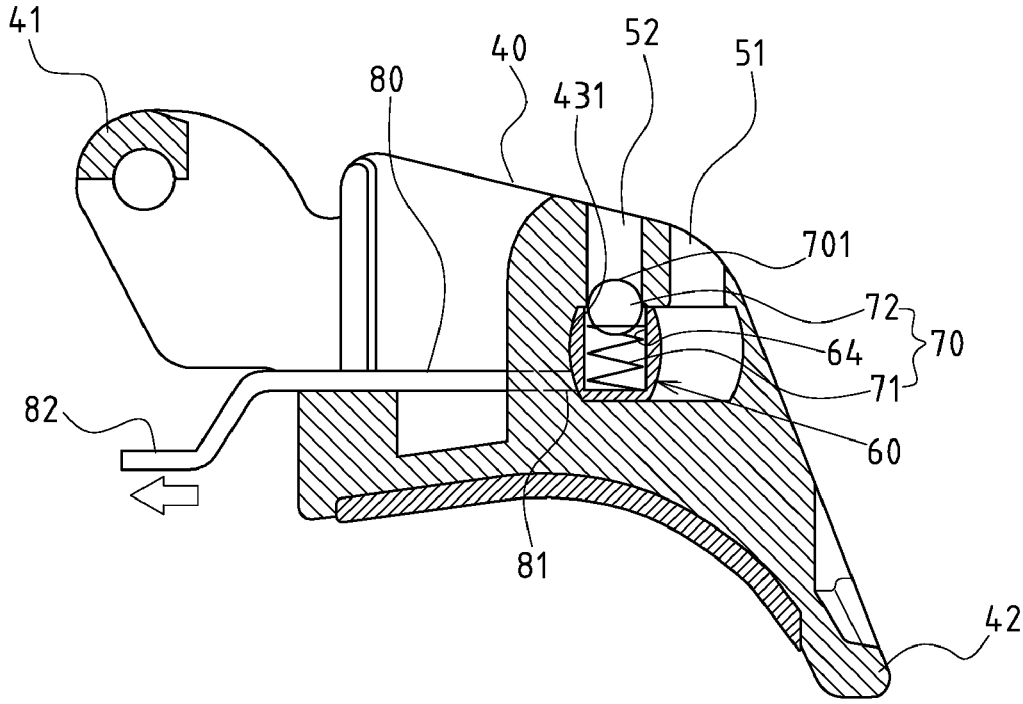
FIG. 13 shows another cross-sectional view of the preferred embodiment in the operation of FIG. 12.

Referring also to FIGS. 5, 12, and 13, when the shift lever 60 moves to the second position, and the flexible snapper 701 of flexible locator 70 aligns with second positioning section 52 of trigger 40. The bead 72 will be supported by the flexible member 71 for snapping again. In such case, the motion tab 80 moves to the pin joint end 41 of trigger 40, so a continuous triggering mode is made available. When the safety lever 44 presses the targets for nailing purposes, it will still push the driving section 82 of motion tab 80 to swing inwards for contact with air switch 45. In such a case, a triggering action is activated if the trigger 40 is pressed. But, the difference is that, when safety lever 44 is disengaged from the target after completion of triggering, the driving section 82 is still located in the movement path of safety lever 44 due to extended shift path of driving section 82 of the motion tab 80. In such a case, if the operator continuously holds the trigger and forces the safety lever 44 to press against the targets, the driving section 82 will be forcibly pushed to contact the air switch 45 for continuous triggering.

Figure 14:
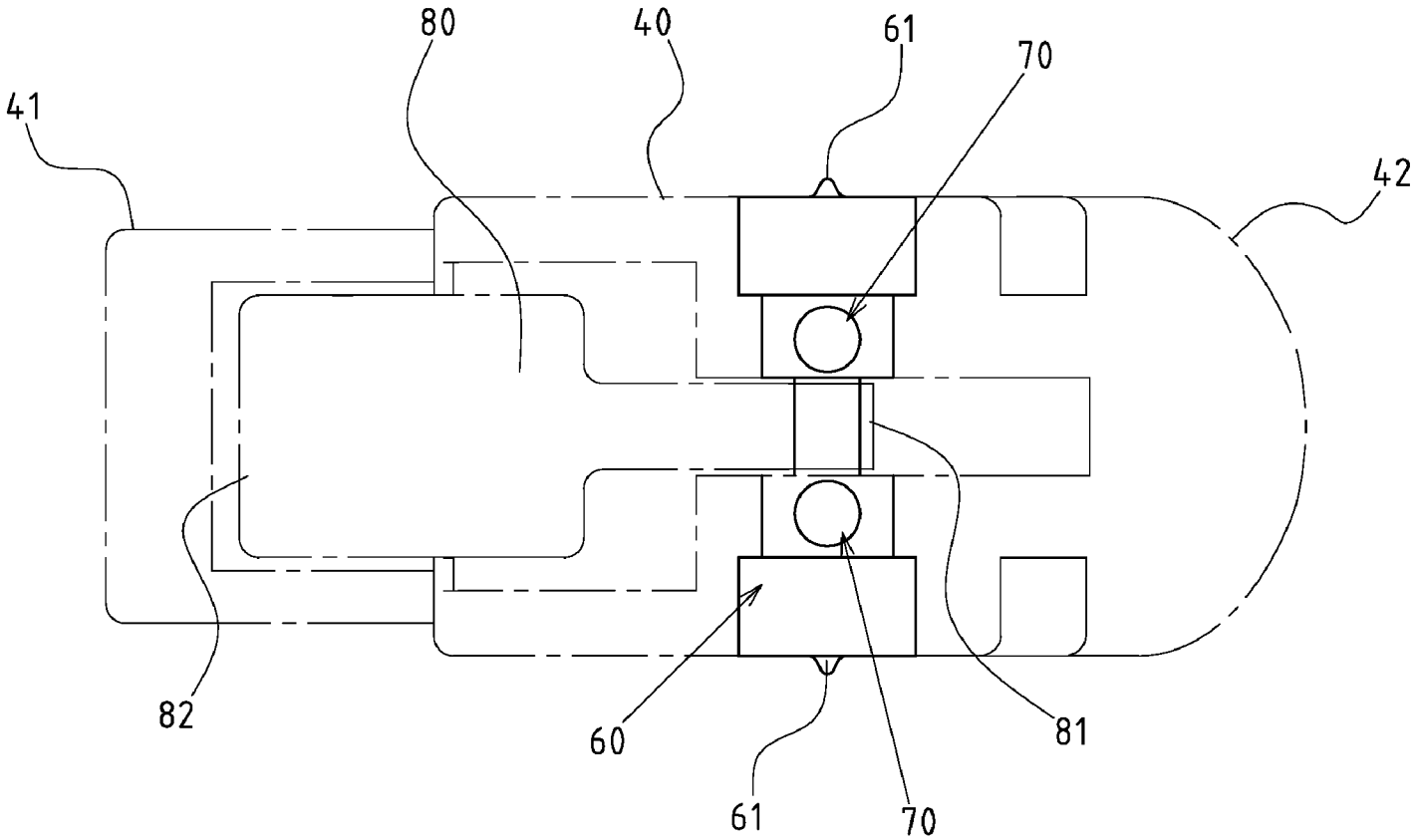
FIG. 14 shows a schematic view of another preferred embodiment of the shift lever control button of the present invention.

Referring to FIG. 6, only one end of the shift lever 60 is provided with a control button 61. Referring to FIG. 14, two ends of the shift lever 60 are provided with control buttons 61 and blockers 65, thus offering two optional control modes for the benefit of operators.

We claim:

1. A shift lever switching mechanism for a trigger of a nailer, said trigger being comprised of a trigger body, a pin joint end, a trigger end and a motion tab, said switching mechanism being mounted on said trigger body and comprising:

at least one guide groove, being mounted between said pin joint end and said trigger end and passing laterally through said trigger, said guide groove having a first positioning section and a second positioning section arranged at intervals onto preset locations of said guide groove; and a shift lever, being mounted within said guide groove and being linked to one end of said motion tab, said shift lever having a control button and a blocker separately placed at two ends of said shift lever, said control button having a container with a flexible locator, said flexible locator having a flexible snapper, said shift lever being limited by said blocker at one end of said guide groove, wherein said control button shifts between the first and second positioning sections along with said motion tab, said flexible snapper snapping with said first positioning section when said control button shifts to said first position and snapping with said second positioning section when said control button shifts to said second position.

2. The shift lever switching mechanism defined in claim 1, wherein said guide groove comprises an internal through hole and an external grooved section.

3. The shift lever switching mechanism defined in claim 1, wherein the first and second positioning sections are formed in a through hole pattern.

4. The shift lever switching mechanism defined in claim 1, wherein said blocker of said shift lever has a snap ring assembled onto one end of said shift lever.

5. The shift lever switching mechanism defined in claim 1, wherein said flexible locator comprises a flexible member and a bead, said flexible locator being accommodated in a container of said shift lever, forming a flexible snapper at a top of said bead protruding from said container.

6. The shift lever switching mechanism defined in claim 1, wherein said shift lever comprises a container for insertion of said flexible locator.

* * * * *